US010940361B2

(12) United States Patent
Matin et al.

(10) Patent No.: US 10,940,361 B2
(45) Date of Patent: Mar. 9, 2021

(54) AQUATIC EXERCISE SYSTEM

(71) Applicants: Amir Hossein Matin, Tabriz (IR); Seyed Masoud Esmailzadeh Milany, Tabriz (IR)

(72) Inventors: Amir Hossein Matin, Tabriz (IR); Seyed Masoud Esmailzadeh Milany, Tabriz (IR)

(73) Assignee: TARAHANE FANNAVARIHAYE TEBBI MATIN, Tabriz (IR)

( * ) Notice: Subject to any disclaimer, the term of this patent is extended or adjusted under 35 U.S.C. 154(b) by 75 days.

(21) Appl. No.: 16/241,072

(22) Filed: Jan. 7, 2019

(65) Prior Publication Data

US 2019/0134458 A1 May 9, 2019

Related U.S. Application Data

(60) Provisional application No. 62/614,420, filed on Jan. 7, 2018.

(51) Int. Cl.
*A63B 22/02* (2006.01)
*A63B 22/06* (2006.01)
(Continued)

(52) U.S. Cl.
CPC ..... *A63B 22/02* (2013.01); *A63B 21/0084* (2013.01); *A63B 21/068* (2013.01); *A63B 22/0605* (2013.01); *A63B 23/0464* (2013.01); *A63B 71/022* (2013.01); *A61H 2201/10* (2013.01); *A61H 2203/02* (2013.01); *A63B 21/0004* (2013.01); *A63B 22/0023* (2013.01);
(Continued)

(58) Field of Classification Search
CPC ... A63B 22/02; A63B 21/068; A63B 23/0464; A63B 71/022; A63B 22/0605; A63B 21/0084; A63B 2225/50; A63B 2225/64; A63B 22/0023; A63B 2225/60; A63B 1/0004; A63B 2208/03; A63B 1/00; A63B 21/00; A63B 2220/72; A63B 24/0087; A63B 71/0619; A61H 2203/02; A61H 2201/10; F24H 1/0081; A47K 3/16; E04H 4/1672; E04H 4/1645
See application file for complete search history.

(56) References Cited

U.S. PATENT DOCUMENTS 3,485,213 A * 12/1969 Scanlon ..... A01K 15/027 119/700
4,001,899 A * 1/1977 Mathis ..... A63B 69/125 4/489
(Continued)

*Primary Examiner* — Nyca T Nguyen
*Assistant Examiner* — Andrew M Kobylarz
(74) *Attorney, Agent, or Firm* — Bajwa IP Law Firm; Haris Zaheer Bajwa

(57) ABSTRACT

An aquatic exercise system may include a water tank including a watertight entrance that may allow a user enter and exit the water tank. The aquatic exercise system may further include a vertical watertight gate that may be disposed within the water tank and divide an interior of the water tank into a first tank portion and a second tank portion, a treadmill assembly that may be disposed within the second tank portion, and a water circulation mechanism that may be connected in fluid communication with the first tank portion and the second tank portion and transfer the water between the first tank portion and the second tank portion.

18 Claims, 16 Drawing Sheets

(51) Int. Cl.

| | |
|---|---|
| ***A63B 21/008*** | (2006.01) |
| ***A63B 21/068*** | (2006.01) |
| ***A63B 23/04*** | (2006.01) |
| ***A63B 71/02*** | (2006.01) |
| ***A63B 21/00*** | (2006.01) |
| ***A63B 22/00*** | (2006.01) |

(52) U.S. Cl.
CPC ..... *A63B 2208/03* (2013.01); *A63B 2225/50* (2013.01); *A63B 2225/60* (2013.01); *A63B 2225/64* (2013.01)

(56) References Cited

U.S. PATENT DOCUMENTS

| | | | | | |
|---|---|---|---|---|---|
| 4,443,900 | A * | 4/1984 | Remeyer | A61H 33/0087 | 4/488 |
| 4,944,506 | A * | 7/1990 | Keller | A61H 33/0087 | 4/507 |
| 5,108,088 | A * | 4/1992 | Keller | A61H 33/0087 | 4/507 |
| 5,295,929 | A * | 3/1994 | Weisz | A63B 22/02 | 4/495 |
| 6,475,095 | B1 * | 11/2002 | Henry | A63G 3/00 | 405/79 |
| 2003/0141232 | A1 * | 7/2003 | Queirel | E04H 4/1272 | 210/167.12 |

* cited by examiner

300

AQUATIC EXERCISE SYSTEM

CROSS-REFERENCE TO RELATED APPLICATION

This application claims the benefit of priority from U.S. Provisional Patent Application Ser. No. 62/614,420, filed on Jan. 7, 2018, and entitled "TWO STAGE ENTRANCE STRUCTURE AND METHOD FOR AQUATIC TREADMILL," which is incorporated herein by reference in its entirety.

SPONSORSHIP STATEMENT

This application has been sponsored by Tabriz University of Medical Sciences, which does not have any rights in this application.

TECHNICAL FIELD

The present disclosure relates to physical training systems, particularly relates to systems and methods for underwater physical training, and more particularly relates to underwater exercise systems with aquatic treadmills.

BACKGROUND

Treadmills are widely used in exercise and therapy procedures and they allow a user to adjust speed and resistance during walking or running based on their exercise or therapy routine. However, for heavy weight users or injured users that may not tolerate pressure of walking and running on their joints or injured body parts, treadmills may not be used. To address this issue, aquatic or underwater treadmills may be utilized and the user may walk or run while partially submerged in water.

Aquatic treadmill systems may be developed by disposing a water-resistant treadmill in a pool, which may limit the use of these types of treadmills to swimming pools or therapy centers having access to a pool. Aquatic treadmill systems may also be developed by disposing a water-resistant treadmill in a watertight tank that may be in fluid communication with a separate water storage tank that provides the required amount of water needed in the aquatic treadmill system. This way, the aquatic treadmill system application is not limited to pools. In these types of aquatic treadmill systems, a user may enter the watertight tank over a treadmill that is installed in the watertight tank and then the required amount of water may be pumped from an external water storage tank into the watertight treadmill tank.

Aquatic treadmill systems that place the treadmill inside a watertight treadmill tank and then use an external water storage tank to pump the required water in and out of the watertight treadmill tank may require laying two separate foundations for both the watertight treadmill tank and the external water storage tank, since once filled, these tanks may weigh up to two metric tons which requires a suitable foundation that may tolerate this amount of water. Furthermore, when the user enters the watertight treadmill tank it may take a long time to pump the entire required water from the external storage tank into the watertight tank and also when the user is done with their therapy or exercise it may take a long time to discharge all the water from the watertight treadmill tank back into the external storage tank. These time-consuming startup and shutdown procedures in these types of aquatic treadmill systems may be time-consuming, irritating, and unhealthy for heavy-weight, injured, or elderly users.

There is, therefore, a need for an aquatic treadmill system that does not require an external storage tank for storing the required water for the treadmill system and as a result does not require a complex installation process involving laying two separate foundations for the aquatic treadmill tank and the external storage tank. Furthermore, there is a need for an aquatic treadmill system with a faster startup and shutdown procedures that are not exhausting or irritating for heavy-weight, injured, or elderly users.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure is directed to an aquatic exercise system. The exemplary aquatic exercise system may include a water tank including a watertight entrance that may allow a user enter and exit the water tank. The aquatic exercise system may further include a vertical watertight gate that may be disposed within the water tank and divide an interior of the water tank into a first tank portion and a second tank portion, a training/therapy assembly that may be disposed within the second tank portion, and a water circulation mechanism that may be connected in fluid communication with the first tank portion and the second tank portion and transfer the water between the first tank portion and the second tank portion.

In an exemplary embodiment, the water tank may include a unitary base, two side-panels, an end-wall, and an end opening that may be closed by the watertight entrance.

In an exemplary embodiment, the training/therapy assembly may be one of a treadmill assembly, an exercise bike, and support railings, the support railings attached to either one of the two side panels.

In an exemplary embodiment, the training/therapy assembly comprises a treadmill assembly. The treadmill assembly may include two rollers and an endless treadmill belt that may extend around the two rollers. The treadmill assembly may be disposed within a recessed section in the unitary base and a top surface of the treadmill belt may lay flush with a top surface of the unitary base.

In an exemplary embodiment, the vertical watertight gate may include a U-shaped frame including a first upright frame member, a second upright frame member, and a horizontal frame member. The first upright frame member and the second upright frame member may be secured to the two side-panels and the horizontal frame member may be secured to the unitary base, a structural panel that may be hinged to the first upright frame member by a plurality of hinges coupled to a first edge of the structural panel, where the structural panel may pivot on the plurality of hinges about a pivot axis defined by the plurality of hinges, and a lock mechanism that may be configured to latch the structural panel against the U-shaped frame.

In an exemplary embodiment, the structural panel may further include a continuous groove along upright and bottom margins of the structural panel. A sealing strip may be secured within the continuous grove and may project outward toward the U-shaped frame. The lock mechanism may be configured to press the structural panel against the U-shaped frame such that the sealing strip is tightly pressed between the structural panel and the U-shaped frame.

In an exemplary embodiment, the lock mechanism may include an upright attachment member extended along and attached to the second upright frame member. The upright attachment member may include an elongated member with a U-shaped profile with a first set of rectangular slots cut into the elongated member. The exemplary lock mechanism may further include an elongated upright link pivotally coupled with the upright attachment member by a plurality of coupling joints spaced apart along a height of the elongated upright link. Each coupling joint may include a leg coupled at one end to the upright attachment member by a first pin joint and at an opposing end to the elongate upright link by a second pin joint. The elongated upright link may be parallel to the upright attachment member and may be moveable toward the upright attachment member in a locked position and movable away from the upright attachment member in an unlocked position. The exemplary lock mechanism may further include a plurality of lock plates secured to a second edge of the structural panel in alignment with the first set of rectangular slots, each of the plurality of lock plates shaped and sized to fit within a corresponding slot of the first set of rectangular slots.

In an exemplary embodiment, the elongated upright link may include a second set of rectangular slots cut into the elongated upright link. The second set of rectangular slots may be out of alignment with the first set of rectangular slots and the elongated upright link pressing the plurality of lock plates into the first set of rectangular slots in the locked position.

In an exemplary embodiment, the elongated upright link may include a second set of rectangular slots cut into the elongated upright link. The second set of rectangular slots may be aligned with the first set of rectangular slots in the unlocked position allowing the plurality of lock plates to freely move in and out of the first set of rectangular slots.

In an exemplary embodiment, the watertight entrance may include a U-shaped frame including a first upright frame member, a second upright frame member, and a horizontal frame member. The first upright frame member and the second upright frame member may be secured to the two side-panels and the horizontal frame member may be secured to the unitary base, a structural panel that may be hinged to the first upright frame member by a plurality of hinges coupled to a first edge of the structural panel, where the structural panel may pivot on the plurality of hinges about a pivot axis defined by the plurality of hinges, and a lock mechanism that may be configured to latch the structural panel against the U-shaped frame.

In an exemplary embodiment, the water circulation mechanism may include a water pump that may be connected in fluid communication with the first tank portion and the second tank portion via a plurality of pipes. The water pump may be configured to pump the water between the first tank portion and the second tank portion, and a fluid filtration unit that may include at least one of a sand filter and a membrane filter. The fluid filtration unit may be configured to filter out suspended particles and organic compounds from the circulated water.

In an exemplary embodiment, an exemplary aquatic exercise system may further include a control unit that may be functionally coupled with the water circulation system. The control unit may include a processor and a memory coupled with the processor. The memory may include executable instructions that, when executed, cause the processor to urge the water circulation unit to pump the water from the second tank portion to the first tank portion until the liquid in the first tank portion leveled with the liquid in the second tank portion, responsive to the user being in the first tank portion and the watertight entrance being closed, and urge the water circulation unit to pump the liquid from the first tank portion into the second tank portion until a desirable liquid level reached in the second tank portion, responsive to the user being in the second tank portion and the watertight gate being closed. In an exemplary embodiment, the desirable water level may be one of a waist-high water level and a chest-high water level.

According to one or more exemplary embodiment, the present disclosure is directed to a method for operating an exemplary aquatic exercise system. The method may include dividing an interior volume of a water tank into a first tank portion and a second tank portion by mounting a vertical watertight gate within the water tank. The first tank portion and the second tank portion may be isolated from each other in a watertight manner by the vertical watertight gate. The water tank may further include a watertight entrance that may allow a user in and out of the water tank. The method may further include mounting treadmill training/therapy assembly inside the second tank portion, filling the second tank portion with water, allowing a user to enter the first tank portion by opening the watertight entrance, closing the watertight entrance, pumping the water from the second tank portion to the first tank portion until the liquid in the first tank portion leveled with the liquid in the second tank portion, allowing the user to enter the second tank portion by opening the vertical watertight gate, closing the vertical watertight gate, and pumping the liquid from the first tank portion into the second tank portion until a desirable liquid level reached in the second tank portion.

In an exemplary embodiment, the water tank may include two side panels, an end-panel, and a unitary base. Mounting the vertical watertight gate within the water tank may include attaching a U-shaped frame within the water tank. The U-shaped frame may include a first upright frame member, a second upright frame member, and a horizontal frame member. The first upright frame member and the second upright frame member may be attached to the two side-panels and the horizontal frame member may be secured to the unitary base. Mounting the vertical watertight gate within the water tank may further include hinging a structural panel to the first upright frame member by a plurality of hinges coupled to a first edge of the structural panel. The structural panel may pivot on the plurality of hinges about a pivot axis defined by the plurality of hinges.

In an exemplary embodiment, the structural panel may further include a continuous groove along upright and bottom margins of the structural panel. A sealing strip may be secured within the continuous grove projecting outward toward the U-shaped frame. Latching the structural panel against the U-shaped frame in a watertight manner by the lock mechanism may include pressing the structural panel against the U-shaped frame by the lock mechanism such that the sealing strip is tightly pressed between the structural panel and the U-shaped frame.

In an exemplary embodiment, filling the second tank portion with water may include filing the second tank portion with water when the watertight gate is closed.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
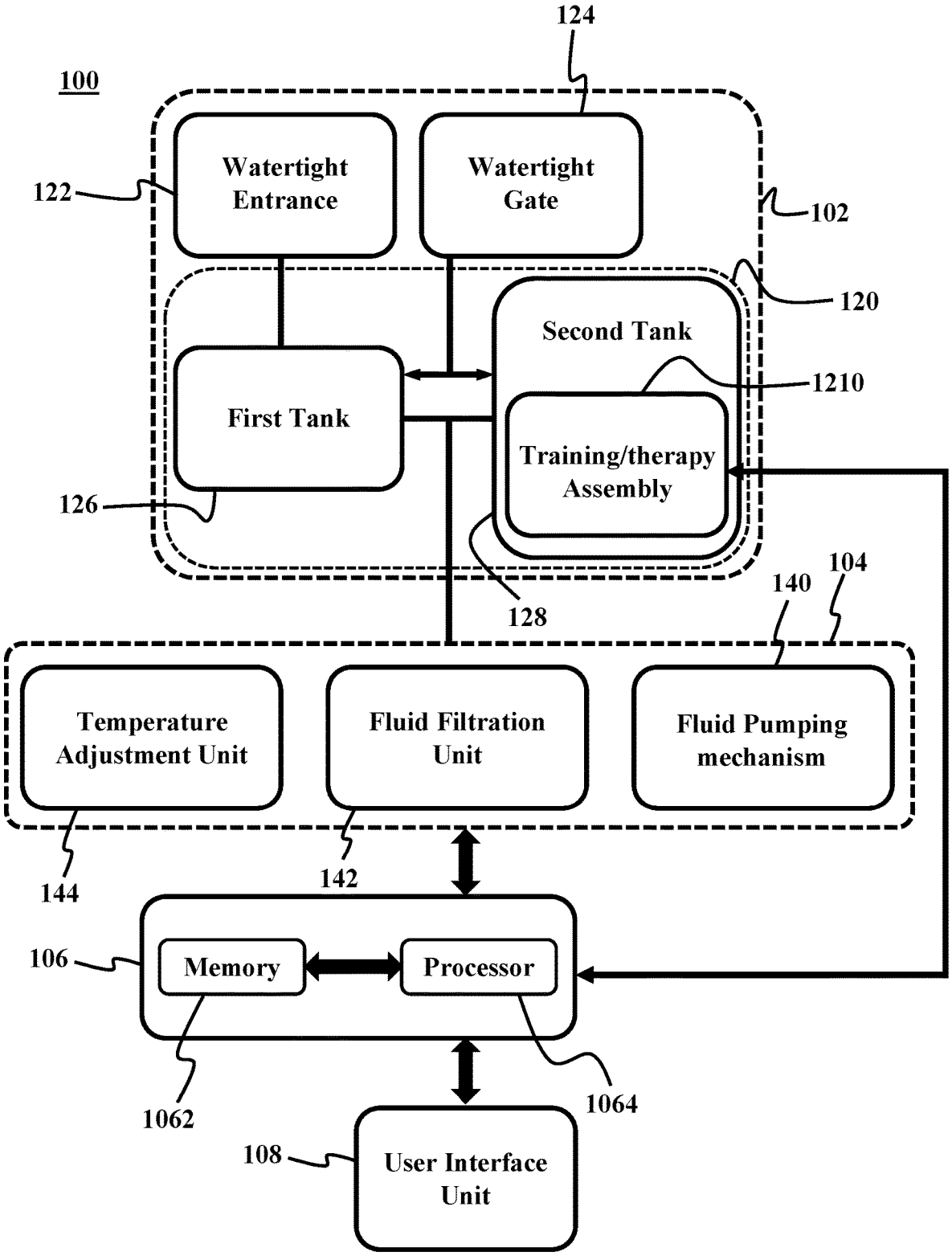
FIG. 1 illustrates a block diagram of an aquatic exercise system, consistent with one or more exemplary embodiments of the present disclosure.

In the following detailed description, numerous specific details are set forth by way of examples to provide a thorough understanding of the relevant teachings related to the exemplary embodiments. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

The present disclosure is directed to exemplary systems and methods for underwater physical training with an aquatic treadmill. The exemplary systems for aquatic exercise may include a watertight tank that may be divided into a first tank portion and a second tank portion by installing a watertight gate within the watertight tank and a treadmill assembly that may be installed in the second tank portion. In an exemplary aquatic exercise method, all the required water for the operation of the aquatic exercise system may be filled in the second tank portion while the first tank portion is empty. Then a user may enter the first tank portion through a watertight entrance and water may be pumped from the second tank portion into the first tank portion by a water circulation mechanism until the water level in the first tank portion reaches the water level in the second tank portion. After that, the user may enter the second tank portion by opening the watertight gate. Finally, water may be pumped back from the first tank portion into the second tank portion until the water in the second tank portion reaches a suitable level for exercise or therapy. In exemplary systems and methods, all the required water may be stored in one place that may be the second tank portion and there is no need for an external storage tank, furthermore, since only a portion of water needs to be transferred between the first tank portion and the second tank portion to allow the user enter or exit the aquatic exercise system, the startup and shutdown procedures of the exemplary aquatic exercise systems is considerably faster than conventional systems and methods.

FIG. 1 illustrates a block diagram of an aquatic exercise system 100, consistent with one or more exemplary embodiments of the present disclosure. In an exemplary embodiment, aquatic exercise system 100 may include an aquatic exercise apparatus 102 that may be utilized for underwater exercise and therapy by allowing a user to enter an exercise tank filled with water and walk or run against the resistance of water, a water circulation system 104 that may be connected in fluid communication with aquatic exercise apparatus 102, a control unit 106 that may be functionally coupled with aquatic exercise apparatus 102 and water circulation system 104, and optionally a user interface unit 108.

In an exemplary embodiment, aquatic exercise apparatus 102 may include a water tank 120 that may hold a predetermined amount of water. Water tank 120 may include a watertight entrance 122 that may be utilized for allowing a user in and out of water tank 120. In an exemplary embodiment, water tank 120 may further include a watertight gate 124 disposed within water tank 120. Watertight gate 124 may divide an interior of water tank 120 into a first tank portion 126 and a second tank portion 128 such that when watertight gate 124 is closed, first tank portion 126 and second tank portion 128 are tightly separated from each other and water may not pass through watertight gate 124 between first tank portion 126 and second tank portion 128. In an exemplary embodiment, a training/therapy assembly 1210 may be disposed within second tank portion 128. Training/therapy assembly 1210 may be one of an underwater treadmill assembly, an exercise bike, or support railings for providing support for a user to perform hydrotherapy moves. Training/therapy assembly 1210 may be utilized for underwater exercise and therapy by allowing the user to perform physical training or therapy while being partially submerged in water.

In an exemplary embodiment, water circulation system 104 may be connected in fluid communication with first tank portion 126 and second tank portion 128. In an exemplary embodiment, water circulation system 104 may be utilized for transferring the liquid between first tank portion 126 and second tank portion 128.

In an exemplary embodiment, water circulation system 104 may include a fluid pumping mechanism 140, a fluid filtration unit 142, and a temperature adjustment unit 144. Fluid pumping mechanism 140 may include at least one pump that may be in fluid communication with first tank portion 126 and second tank portion 128 via one or more pipes. The at least one pump may be utilized for pumping liquid from first tank portion 126 to second tank portion 128 or vice versa.

In an exemplary embodiment, fluid filtration unit 142 may include at least one filtration unit such as a sand filter unit that may be installed or located on a pathway of liquid that is being transferred between first tank portion 126 and second tank portion 128 and the liquid may move through the sand filter and any suspended particle or organic compounds may be separated from the liquid. Fluid filtration unit 142 may further include other filtration units such as membrane filtration units including ultrafiltration membranes. In an exemplary embodiment, fluid filtration unit 142 may further include water disinfection mechanisms that may be utilized for filtering out harmful microorganisms and adding disinfectant chemicals such as chlorine, chloramine, or chlorine dioxide.

In an exemplary embodiment, temperature adjustment unit 144 may include a heater that may be disposed within water circulation system 104. Temperature adjustment unit 144 may be utilized to adjust the temperature of the liquid within water tank 120 at a desirable level by a user.

In an exemplary embodiment, control unit 106 may be coupled to aquatic exercise apparatus 102, and water circulation system 104, and user interface unit 108 through wired links, wireless links, or a combination of wired and wireless links. In an exemplary embodiment, control unit 106 may include a memory 1062 and a processor 1064. Memory 1062 may include executable instructions that, when executed, cause processor 1064 to perform operations that in an exemplary embodiment may include, but are not limited to, controlling training/therapy assembly 1210, adjusting the temperature of water, and adjusting the height of liquid in first tank portion 126 and second tank portion 128.

In an exemplary embodiment, control unit 106 may be functionally coupled with training/therapy assembly 1210 and may be configured to control training/therapy assembly 1210 for purposes that may include controlling or adjusting operation of training/therapy assembly 1210 including, but not limited to, controlling and adjusting the speed and inclination of training/therapy assembly 1210. In an exemplary embodiment, control unit 106 may be functionally coupled with water circulation system 104 and may be configured to control water circulation system 104 for purposes that may include, but are not limited to, adjusting the temperature of water utilizing temperature adjustment unit 144 and adjusting the height of liquid in first tank portion 126 and second tank portion 128 utilizing fluid pumping mechanism 140.

In an exemplary embodiment, user interface unit 108 may include a graphical user interface unit (GUI) that may be optionally configured to receive data input from a user. In an exemplary embodiment, data input by the user may include operational variables of training/therapy assembly 1210 such as a value for speed and a value for inclination of a treadmill assembly or an exercise bike, a desirable value for the height of liquid in second tank portion 128, and a desirable value for temperature of the liquid within aquatic exercise apparatus 102.

Figure 2:
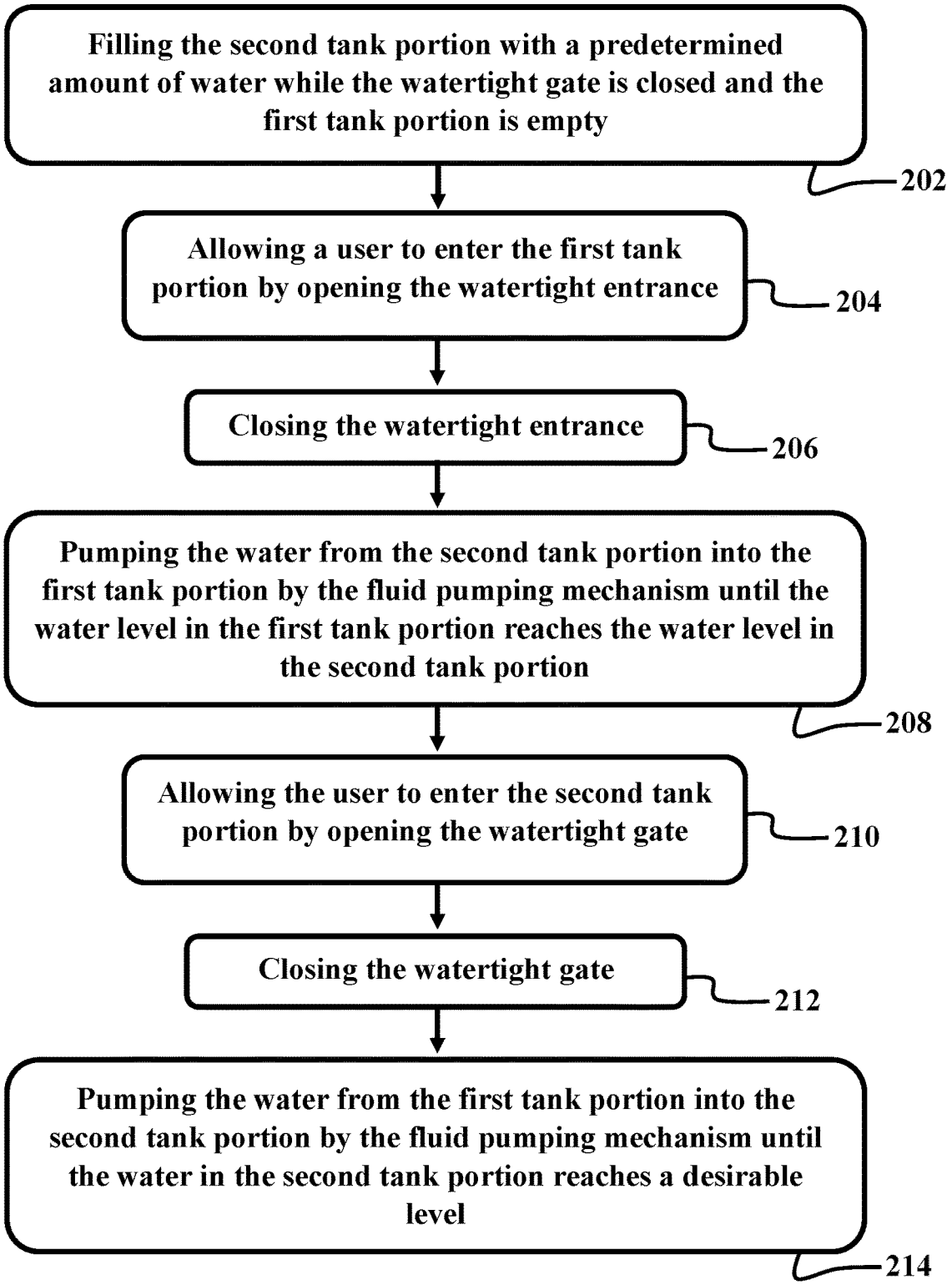
FIG. 2 illustrates a method for operating an aquatic exercise system, consistent with one or more exemplary embodiments of the present disclosure.

FIG. 2 illustrates a method 200 for operating an aquatic exercise system, consistent with one or more exemplary embodiments of the present disclosure. In an exemplary embodiment, method 200 may be utilized for operating an aquatic exercise system similar to aquatic exercise system 100 of FIG. 1.

Referring to FIGS. 1 and 2, in an exemplary embodiment, method 200 may include a step 202 of filling second tank portion 128 with a predetermined amount of water while watertight gate 124 is closed and first tank portion 126 is empty, a step 204 of allowing a user to enter first tank portion 126 by opening watertight entrance 122, a step 206 of closing watertight entrance 122, a step 208 of pumping the water from second tank portion 128 into first tank portion 126 by fluid pumping mechanism 140 until the water level in first tank portion 126 reaches the water level in second tank portion 128, a step 210 of allowing the user to enter second tank portion 128 by opening watertight gate 124, a step 212 of closing watertight gate 124, and a step 214 of pumping the water from first tank portion 126 into second tank portion 128 by fluid pumping mechanism 140 until the water in second tank portion 128 reaches a desirable level. After that, the user may utilize training/therapy assembly 1210 for performing physical training or therapy while being partially submerged in the water in second tank portion 128. In an exemplary embodiment, the desirable water level may be waist- or chest-high to allow the user to perform different types of aquatic exercises while being partially submerged in water.

Figure 3A:
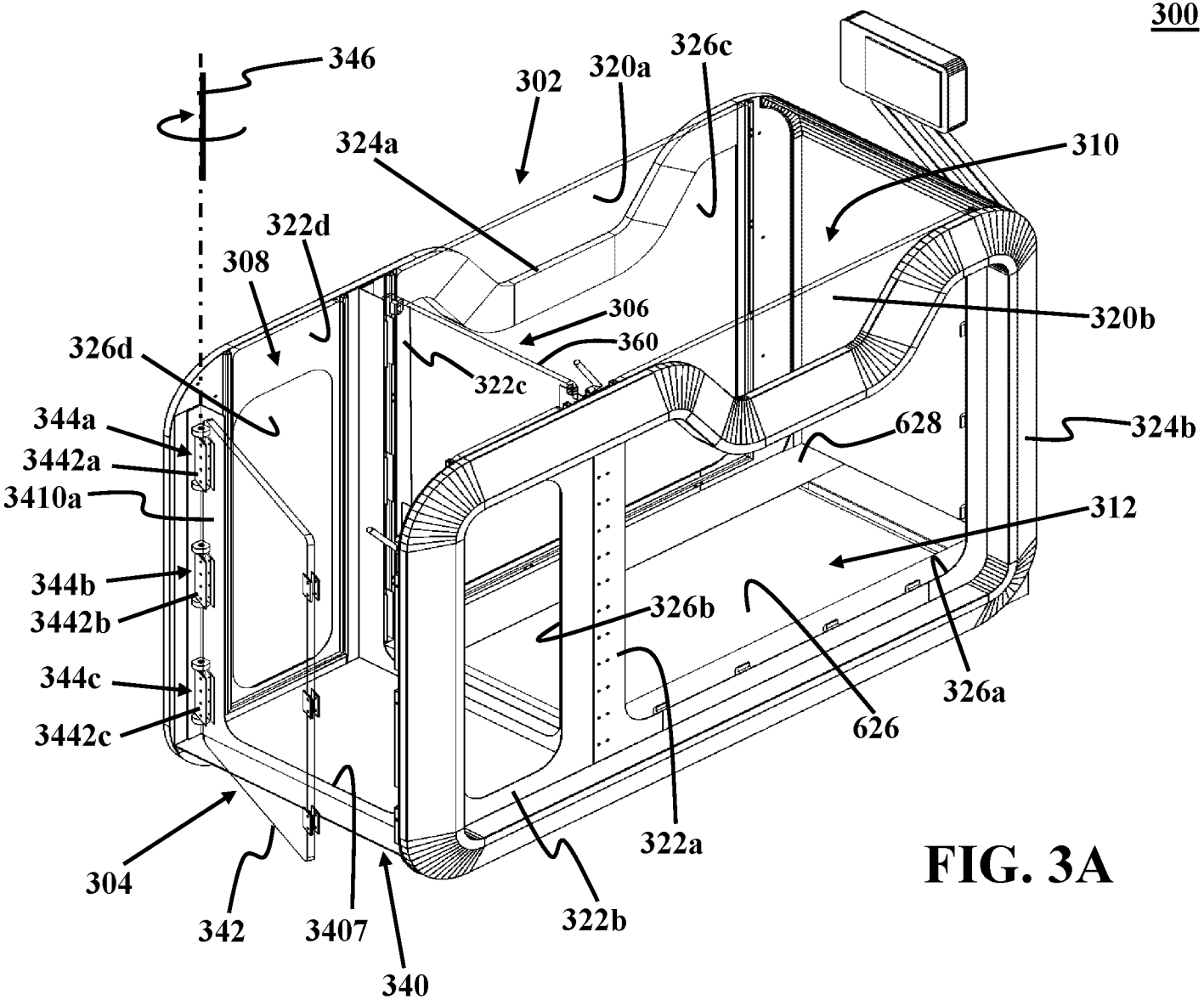
FIG. 3A illustrates a right-side perspective view of an aquatic exercise apparatus, consistent with one or more exemplary embodiments of the present disclosure.

FIG. 3A illustrates a right-side perspective view of an aquatic exercise apparatus 300, consistent with one or more exemplary embodiments of the present disclosure. In an exemplary embodiment, aquatic exercise apparatus 300 may be similar to aquatic exercise apparatus 102 of FIG. 1.

Referring to FIG. 3A, in an exemplary embodiment, aquatic exercise apparatus 300 may include a water tank 302 that may hold a predetermined amount of water. Water tank 302 may include a watertight entrance 304 that may be utilized for allowing a user in and out of water tank 302. In an exemplary embodiment, water tank 302 may further include a watertight gate 306 disposed within water tank 302. Watertight gate 306 may divide an interior of water tank 302 into a first tank portion 308 and a second tank portion 310. In an exemplary embodiment, a training/therapy assembly similar to training/therapy assembly 1210 of FIG. 1, for example a treadmill assembly 312 may be disposed within second tank portion 310. Treadmill assembly 312 may be an underwater treadmill that may be utilized for underwater exercise and therapy by allowing a user to walk or run while being partially submerged in water.

In an exemplary embodiment, water tank 302 may be a rectangular tank with an open top and an entrance opening which is closed by watertight entrance 304. Side walls 320*a-b* of water tank 302 may be of transparent sheet material. In an exemplary embodiment, aquatic exercise apparatus 300 may further include side-panels 322*a-d* and support frames 324*a-b* that together with side walls 320*a-b* may form side windows 326*a-d*. In exemplary embodiments, such configuration of side windows 326*a-d* may allow a user or therapist to monitor performance of the user and judge the desired level of water in first tank portion 308 and second tank portion 310 during transferring of water between first tank portion 308 and second tank portion 310.

Figure 3B:
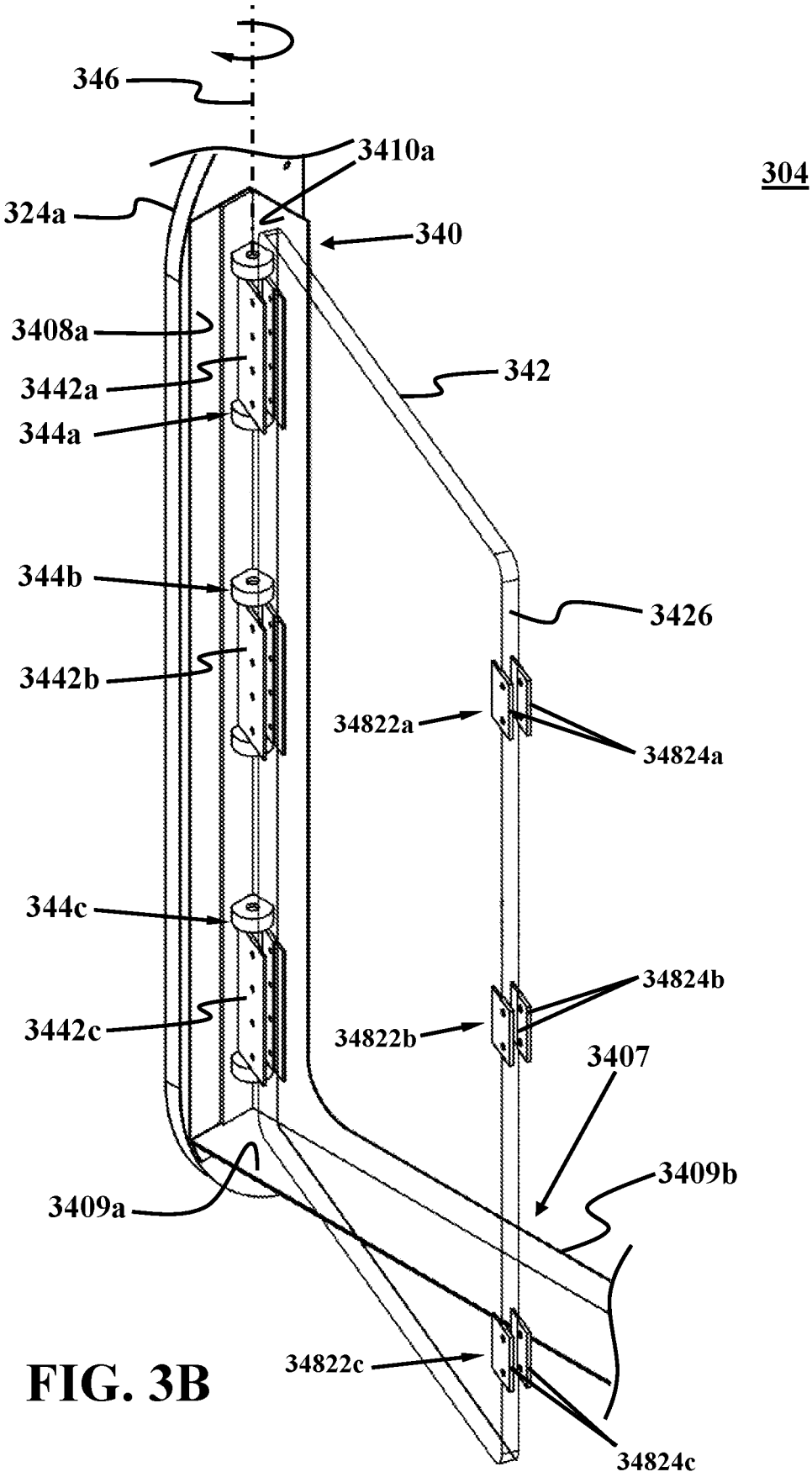
FIG. 3B illustrates a sectional right perspective view of a watertight entrance, consistent with one or more exemplary embodiments of the present disclosure.
Figure 3C:
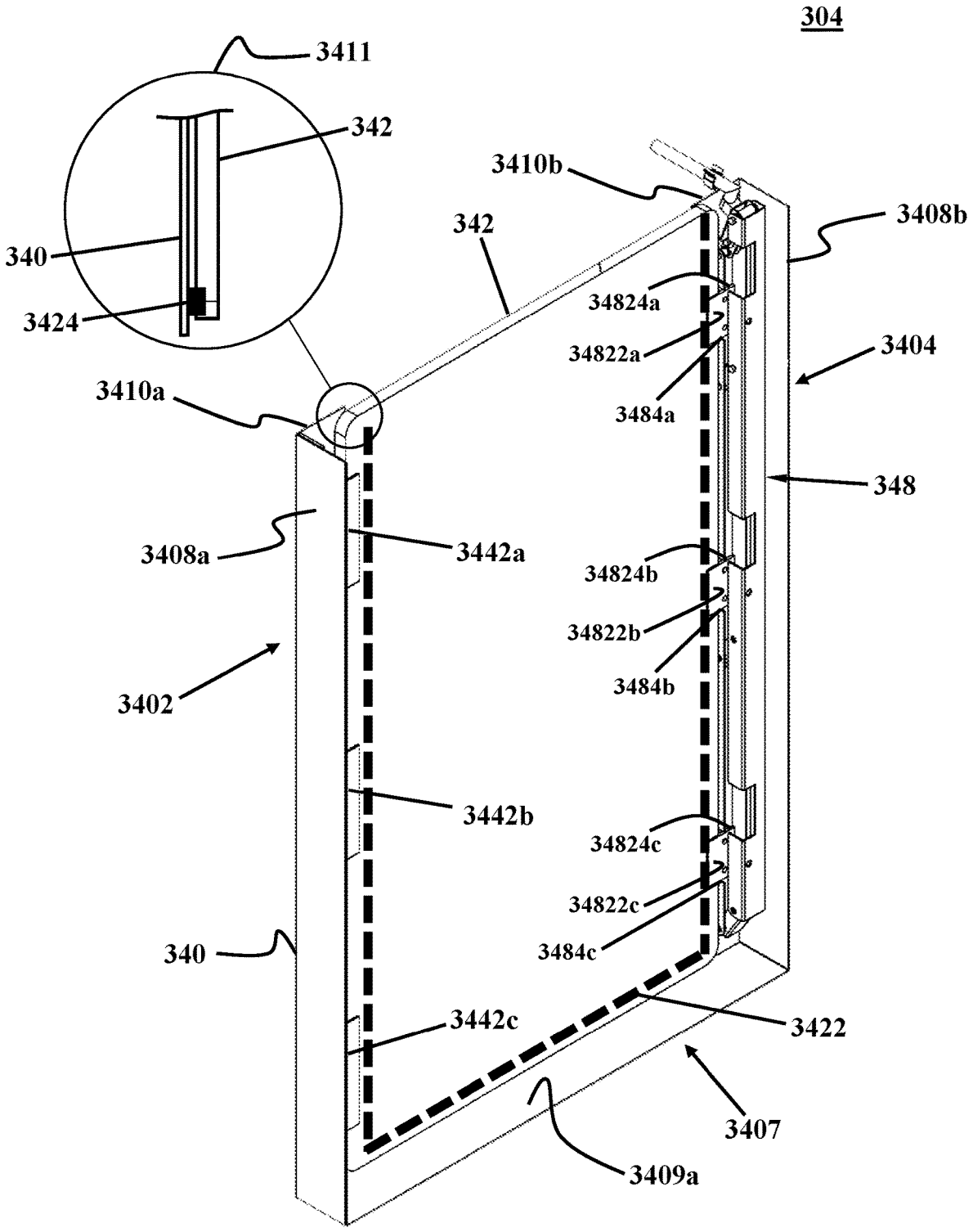
FIG. 3C illustrates a left perspective view of a watertight entrance, consistent with one or more exemplary embodiments of the present disclosure.

FIG. 3B illustrates a sectional right perspective view of watertight entrance 304, consistent with one or more exemplary embodiments of the present disclosure. FIG. 3C illustrates a left perspective view of watertight entrance 304, consistent with one or more exemplary embodiments of the present disclosure.

Referring to FIGS. 3A-3C, in an exemplary embodiment, watertight entrance 304 may include a U-shaped entrance frame 340 that may be bolted to support frames 324*a-b*. U-shaped entrance frame 340 may include a first upright frame member 3402, a second upright frame member 3404, and a horizontal frame member 3407. First upright frame member 3402 and second upright frame member 3404 may be vertically extended members made of panels 3406*a-b* facing support members 324*a-b*, where each of panels 3406*a-b* may be bolted to a corresponding support member 324*a* or 324*b* and two panels 3408*a-b* integrally formed with and perpendicular to panels 3406*a-b*. In an exemplary embodiment, horizontal frame member 3407 may include a base plate 3409*a* and an upright rim 3409*b* attached or otherwise integrally formed with base plate 3409*a*.

In an exemplary embodiment, watertight entrance 304 may further include a structural panel 342 that may be hinged to panel 3408*a* of first upright frame member 3402 by hinges 344*a-c*. In an exemplary embodiment, an axis 346 of pivot may be formed by hinges 344*a-c* and structural panel 342 may be opened by pivoting about axis 346 on hinges 344*a-c*. In an exemplary embodiment, structural panel 342 may be mounted on hinges 344*a-c* by securing structural panel 342 in between U-shaped hinge plates 3442*a-c*.

In an exemplary embodiment, watertight entrance 304 may further include a lock mechanism 348 that may be attached to plate 3408*b* of second upright frame member 3404 and may serve to latch structural panel 342 against panels 3408*a-b* and horizontal frame member 3407 of U-shaped entrance frame 340. In other words, lock mechanism 348 may be utilized to press structural panel 342 against U-shaped entrance frame 340. In an exemplary embodiment, structural panel 342 may include a continuous groove 3422 along its upright and bottom margins along dashed line (labeled 3422) shown in FIG. 3C. A sealing strip 3424 such as a rubber strip may be secured in continuous groove 3422 and may project outward toward U-shaped entrance frame 340. Referring to a magnified top-view inset 3410 in FIG. 3C, in an exemplary embodiment, when watertight entrance 304 is closed, such sealing strip 3424 may engage and be compressed against U-shaped entrance frame 340. In exemplary embodiments, such configuration of structural panel 342, sealing strip 3424, and U-shaped entrance frame 340 allows forming a watertight seal between structural panel 342 and U-shaped entrance frame 340.

Figure 3D:
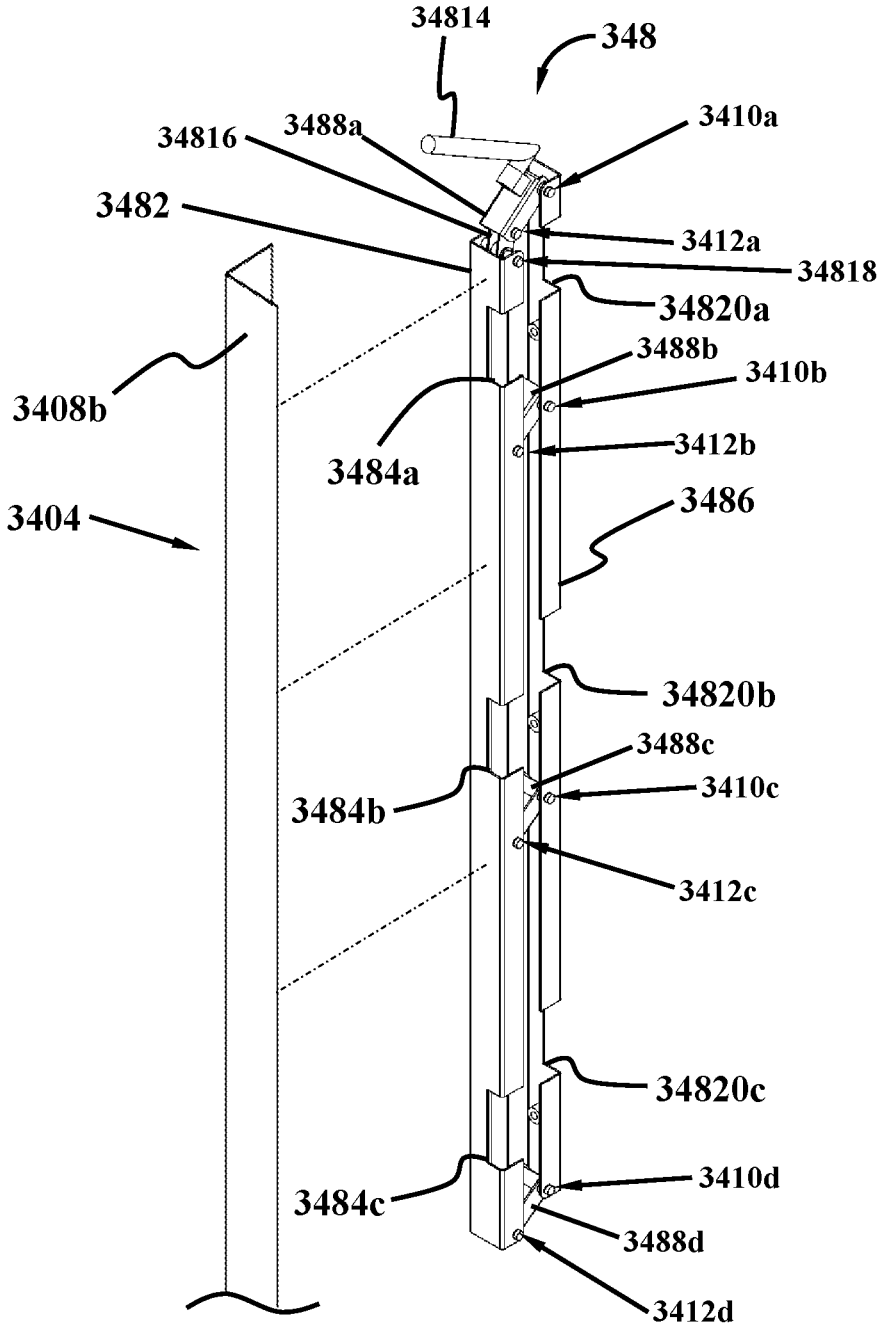
FIG. 3D illustrates a perspective view of a lock mechanism, consistent with one or more exemplary embodiments of the present disclosure.

FIG. 3D illustrates a perspective view of lock mechanism 348, consistent with one or more exemplary embodiments of the present disclosure. In an exemplary embodiment, lock mechanism 348 may include an upright attachment member 3482 that may be an elongated member with a U-shaped profile extended downward spanning along plate 3408*b* of second upright frame member 3404. In an exemplary embodiment, upright attachment member 3482 may be attached to plate 3408*b* by fastening members such as bolts, screws, etc. In an exemplary embodiment, upright attachment member 3482 may include rectangular slots 3484*a-c* cut into upright attachment member 3482. For example, upright attachment member 3482 may include rectangular slot 3484*a* cut at an upper portion of upright attachment member 3482, rectangular slot 3484*b* cut at a middle portion of upright attachment member 3482, and rectangular slot 3484*c* cut at a lower portion of upright attachment member 3482. In an exemplary embodiment, rectangular slot 3484*b* may be equally spaced apart from rectangular slot 3484*a* and rectangular slot 3484*c*.

In an exemplary embodiment, lock mechanism 348 may further include an elongated upright link 3486 with a U-shaped profile that may be as high as upright attachment member 3482. In an exemplary embodiment, elongated upright link 3486 may be pivotally coupled with upright attachment member 3482 by legs 3488*a-d* and pins 34810*a-d* and 34812*a-d*. In exemplary embodiments, such configuration of elongated upright link 3486 and upright attachment member 3482 may allow for pivoting elongated upright link 3486 toward and away from upright attachment member 3482 creating a pushing mechanism that may be used for latching structural panel 342 against panels 3408*a-b* and upright rim 3409*b* of U-shaped entrance frame 340, which will be described later.

In an exemplary embodiment, elongated upright link 3486 may include rectangular slots 34820*a-c* cut into elongated upright link 3486. For example, upright attachment member 3482 may include rectangular slot 34820*a* cut at an upper portion of elongated upright link 3486, rectangular slot 34820*b* cut at a middle portion of elongated upright link 3486, and rectangular slot 34820*c* cut at a lower portion of elongated upright link 3486. In an exemplary embodiment, rectangular slot 34820*b* may be equally spaced apart from rectangular slot 34820*a* and rectangular slot 34820*c*.

In an exemplary embodiment, lock mechanism 348 may further include a lever 34814 that may be attached on top of leg 3488*a* away from pin 3412*a* such that up and down movement of lever 34814 may cause a pivoting movement of leg 3488*a* about pin 3412*a*. In an exemplary embodiment, leg 3488*a* may be connected to upright attachment member 3482 via an extension leg 34816 by pin 3412*a* and a fixed joint 34818. Pin 3412*a* may provide a fixed pivot point for leg 3488*a* and pivoting motion of leg 3488*a* may be actuated by moving lever 34814 up and down by a user.

Referring to FIGS. 3B and 3C, in an exemplary embodiment, lock mechanism 348 may further include lock plates 34822*a-c* that may be attached on an upright edge 3426 of structural panel 342 with a portion of each of lock plates 34822*a-c* extending beyond upright edge 3426 of structural panel 342 forming locking lips 34824*a-c*. In an exemplary embodiment each lock plate 34822*a*, 34822*b*, or 34822*c* may include two parallel plates attached at either interior and exterior faces of structural panel 342. In an exemplary embodiment, lock plates 34822*a-c* may be attached on structural panel 342 such that in a closed position of watertight entrance 304, lips 34824*a-c* of lock plates 34822*a-c* may be aligned with and sit within rectangular slots 3484*a-c* of upright attachment member 3482 (as shown in FIG. 3C).

Figure 4A:
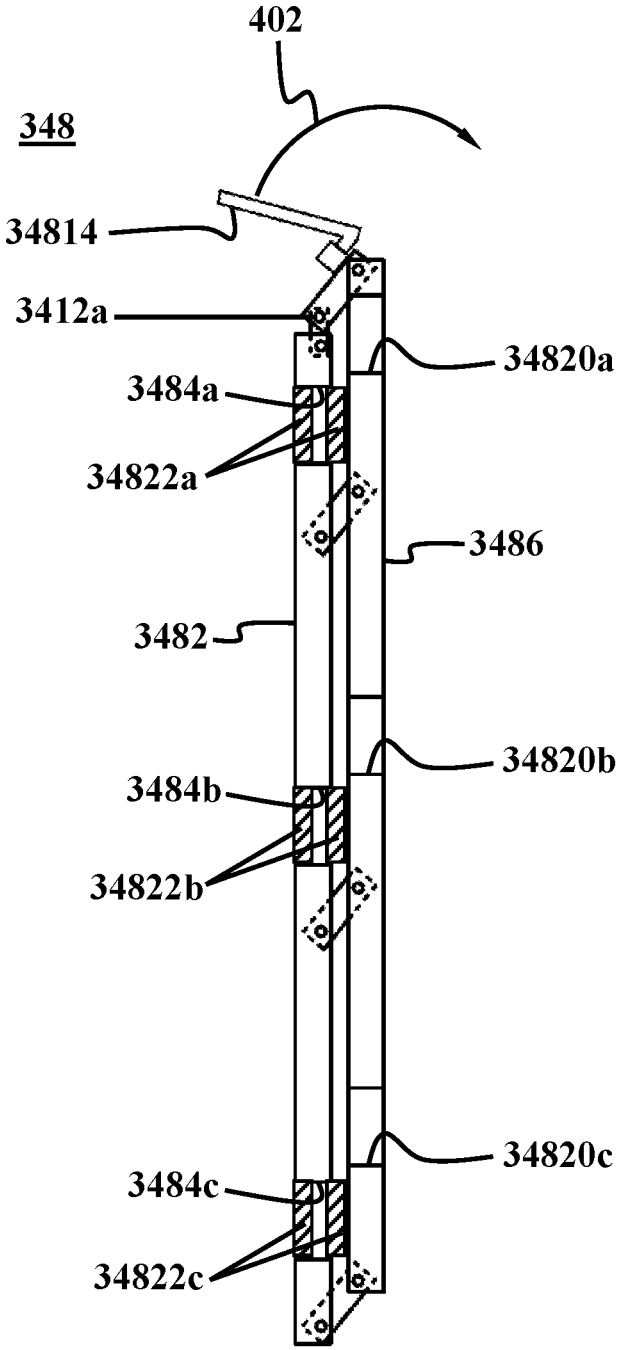
FIG. 4A illustrates a schematic left-view of a lock mechanism in a locked position, consistent with one or more exemplary embodiments of the present disclosure.
Figure 4B:
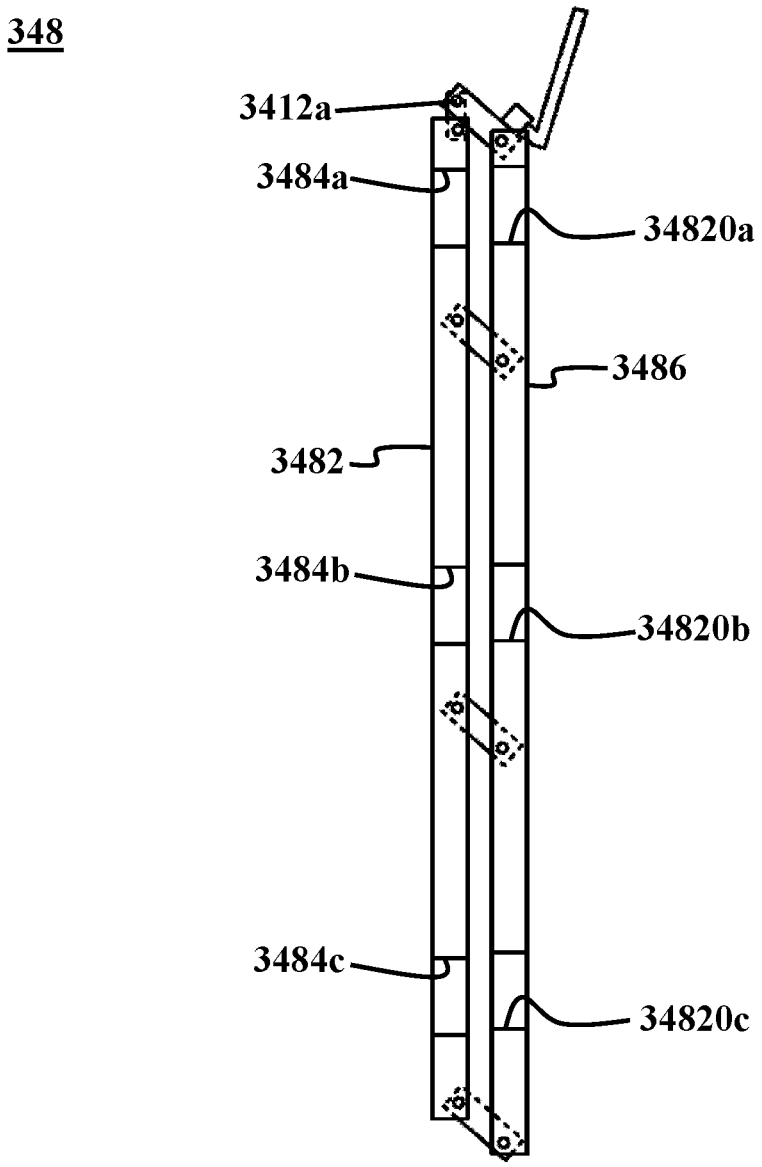
FIG. 4B illustrates a schematic left-view of a lock mechanism in an unlocked position, consistent with one or more exemplary embodiments of the present disclosure.

FIG. 4A illustrates a schematic left-view of lock mechanism 348 in a locked position, consistent with one or more exemplary embodiments of the present disclosure and FIG. 4B illustrates a schematic left-view of lock mechanism 348 in an unlocked position, consistent with one or more exemplary embodiments of the present disclosure.

Referring to FIG. 4A, in an exemplary embodiment, when lock mechanism 348 is in a locked position as shown in this figure, elongated upright link 3486 may be positioned parallel with and slightly higher than upright attachment member 3482 such that rectangular slots 34820*a-c* may be out of alignment with and slightly higher than rectangular slots 3484*a-c*. In exemplary embodiments, such a configuration for elongated upright link 3486 and upright attachment member 3482 in the locked position of lock mechanism 348 may allow elongated upright link 3486 to press lock plates 34822*a-c* into rectangular slots 3484*a-c*. With further reference to FIG. 3C, when elongated upright link 3486 presses lock plates 34822*a-c* into rectangular slots 3484*a-c*, structural plate 342 may be pressed against panels 3408*a-b* and horizontal frame member 3407 of U-shaped entrance frame 340.

Referring to FIGS. 4A and 4B, in an exemplary embodiment, moving lever 34814 down along a path shown by arrow 402 about the fixed pivot point provided by pin 3412*a* may translate elongated upright link 3486 down in an unlocked position as shown in FIG. 4B, where elongated upright link 3486 may be positioned parallel with and slightly lower than upright attachment member 3482 such that rectangular slots 34820*a-c* may be in alignment with rectangular slots 3484*a-c*. In exemplary embodiments, such a configuration for elongated upright link 3486 and upright attachment member 3482 in the unlocked position of lock mechanism 348 may allow lock plates 34822*a-c* to be released and free to move in and out of rectangular slots 3484*a-c*.

Figure 4C:
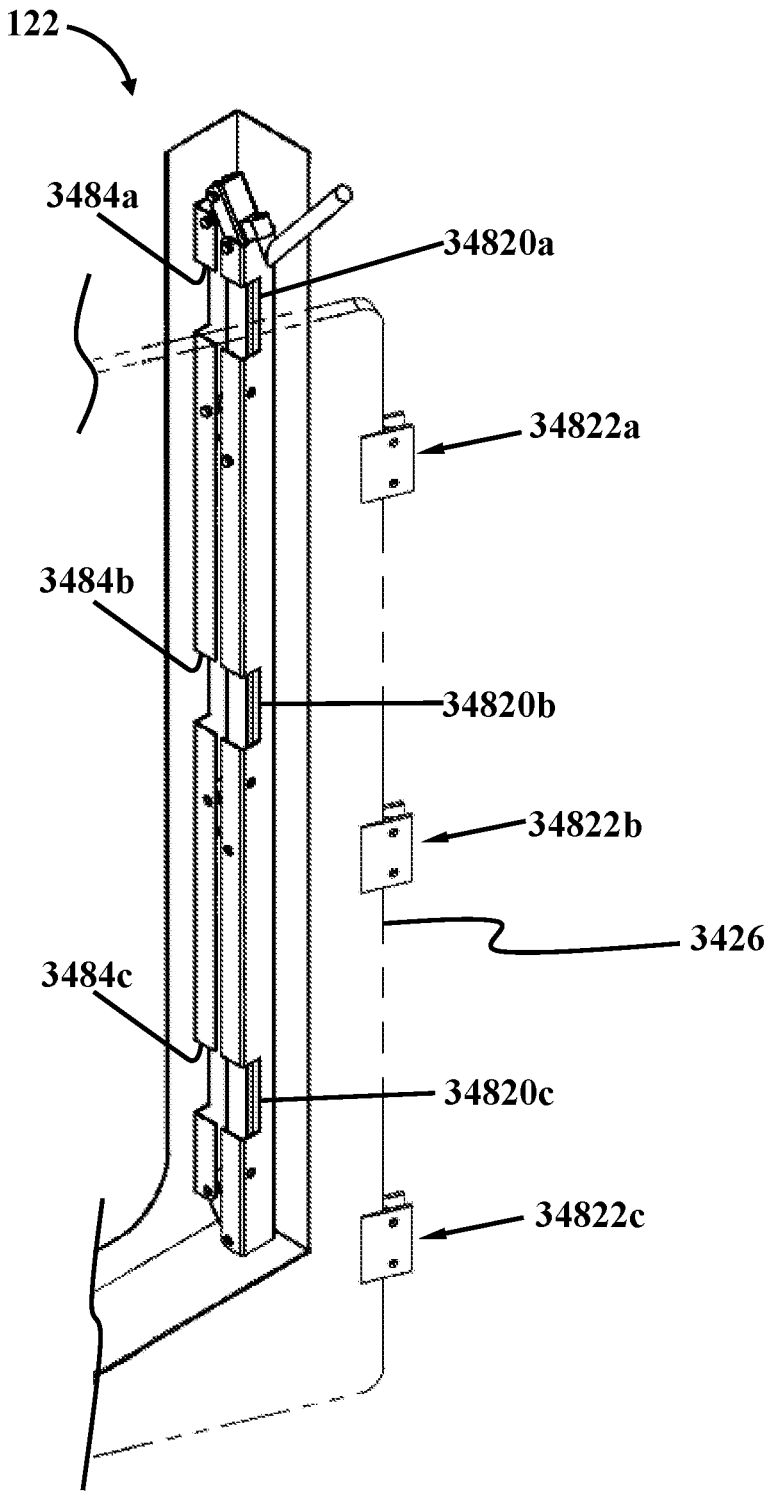
FIG. 4C illustrates a partial perspective view of a watertight entrance, consistent with one or more exemplary embodiments of the present disclosure.

FIG. 4C illustrates a partial perspective view of watertight entrance 122, consistent with one or more exemplary embodiments of the present disclosure. Referring to FIGS. 4B and 4C, in an exemplary embodiment, when rectangular slots 34820*a-c* are aligned with rectangular slots 3484*a-c* in the unlocked positon of lock mechanism 348, lock plates 34822*a-c* may freely move in and out of rectangular slots 3484*a-c* and structural plate 342 may be opened to allow the user to enter or exit through watertight entrance 122.

Referring back to FIG. 3A, in an exemplary embodiment, watertight gate 306 may be structured similar to watertight entrance 304 as was described in detail in connection with FIGS. 3A-3C and FIGS. 4A-4C. In an exemplary embodiment, watertight gate 306 and watertight entrance 304 may be organized in other ways, for example, they may be disposed on slide mechanisms and they may be configured to slidably open and close instead of being pivotally opened and closed as was described in detail in the foregoing paragraphs.

Figure 5:
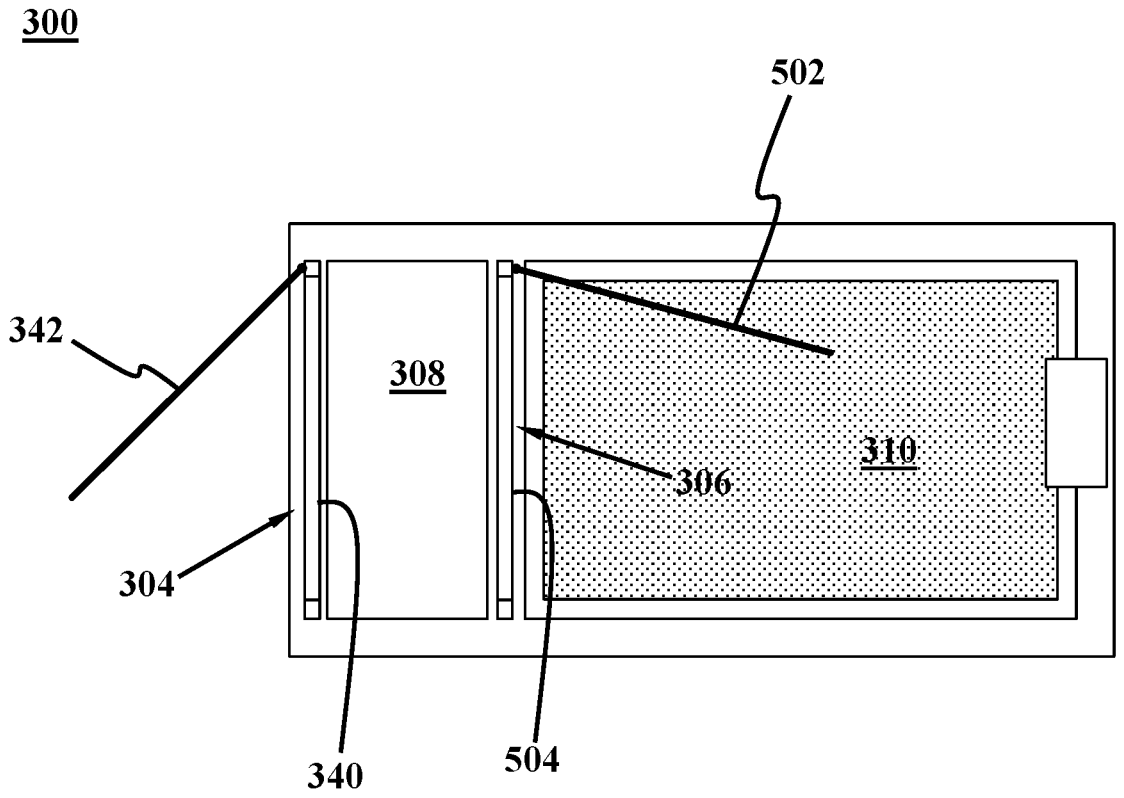
FIG. 5 illustrates a schematic top-view of an aquatic exercise apparatus, consistent with one or more exemplary embodiments of the present disclosure.

FIG. 5 illustrates a schematic top-view of aquatic exercise apparatus 300, consistent with one or more exemplary embodiments of the present disclosure. In an exemplary embodiment, structural plate 342 of watertight entrance 304 may be hinged to U-shaped entrance frame 340 such that structural plate 342 may be swung away from first tank portion 308. In an exemplary embodiment, a structural plate 502 of watertight gate 306 that may be similarly structured as structural plate 342 may be hinged to a U-shaped gate frame 504 that may be similar to U-shaped entrance frame 340, such that, structural plate 502 may be swung open into second tank portion 310.

Figure 6A:
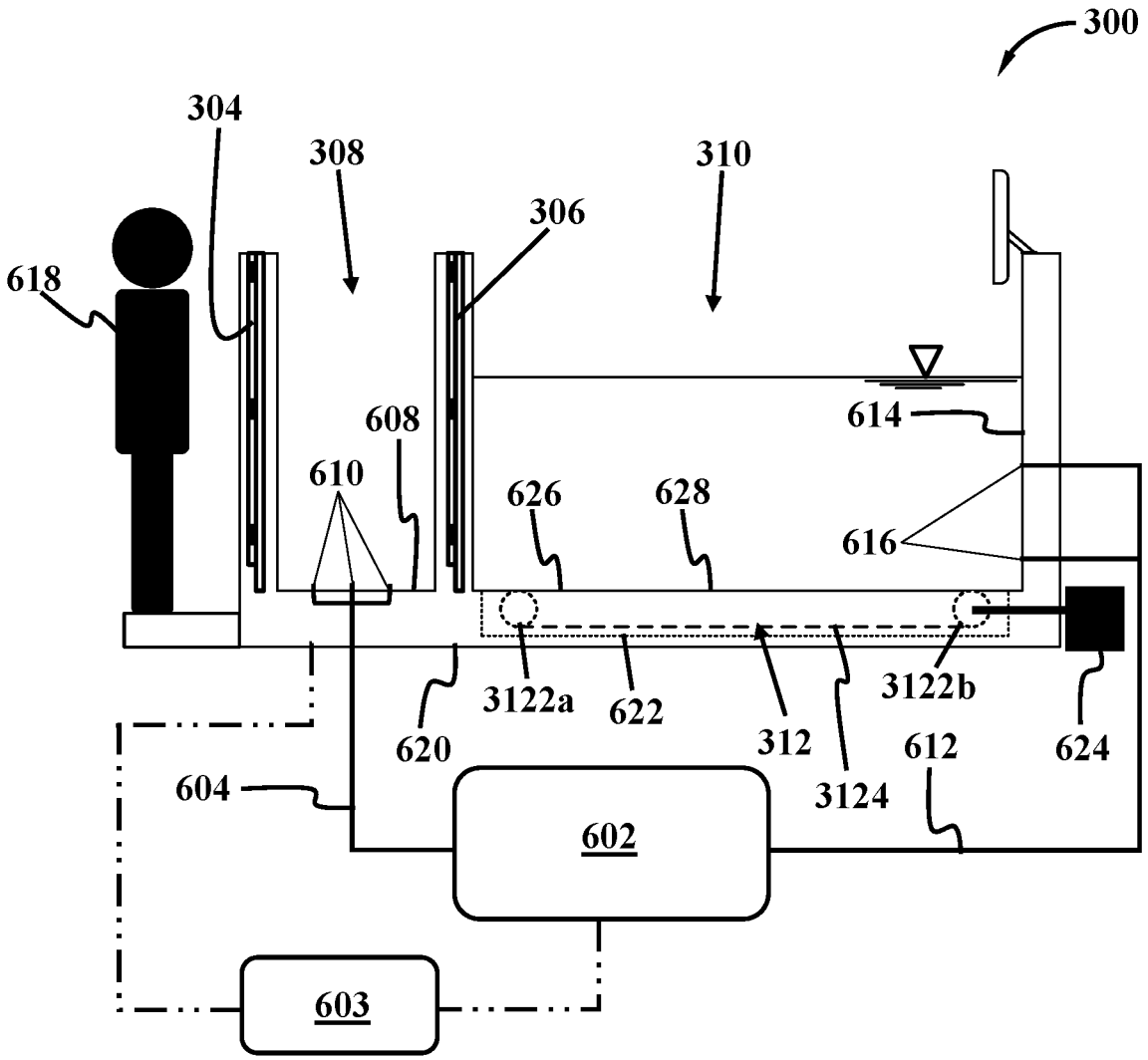
FIG. 6A illustrates a schematic left-view of an aquatic exercise apparatus connected in fluid communication with a water circulation system, consistent with one or more exemplary embodiments of the present disclosure.
Figure 6B:
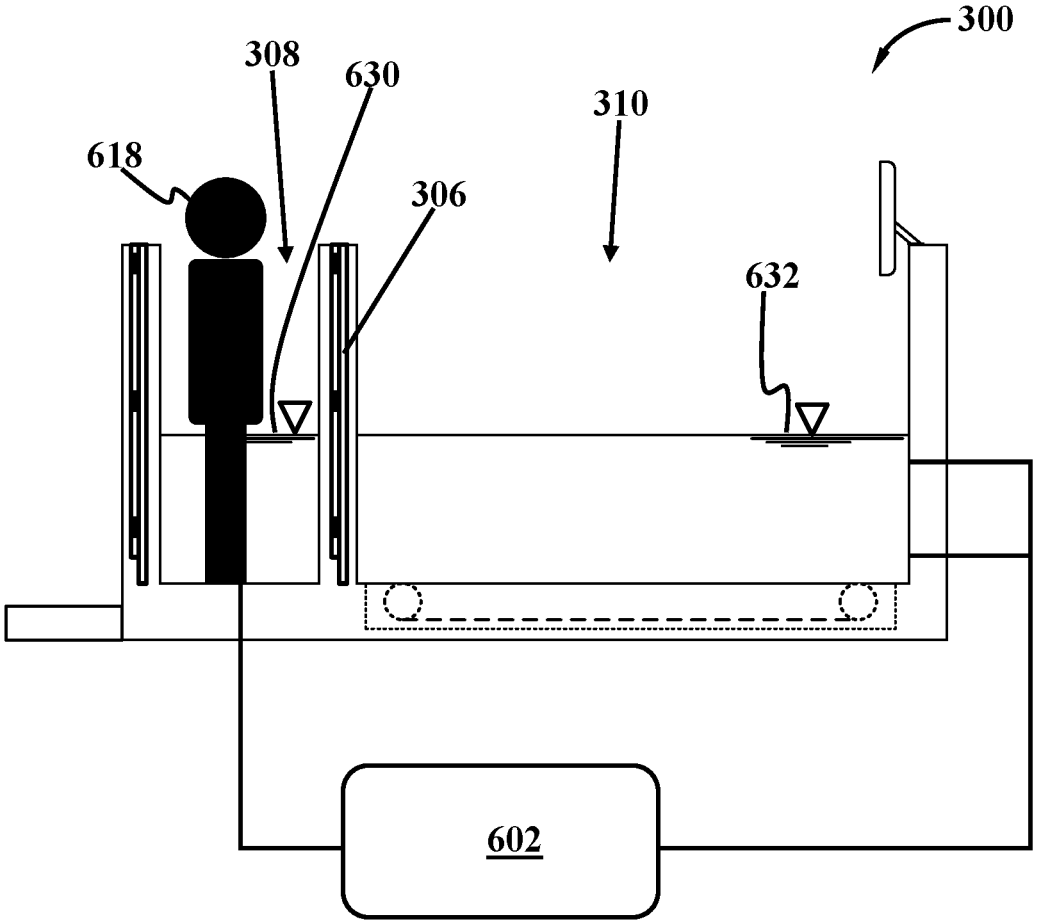
FIG. 6B illustrates a schematic left-view of an aquatic exercise apparatus connected in fluid communication with a water circulation system, consistent with one or more exemplary embodiments of the present disclosure.
Figure 6C:
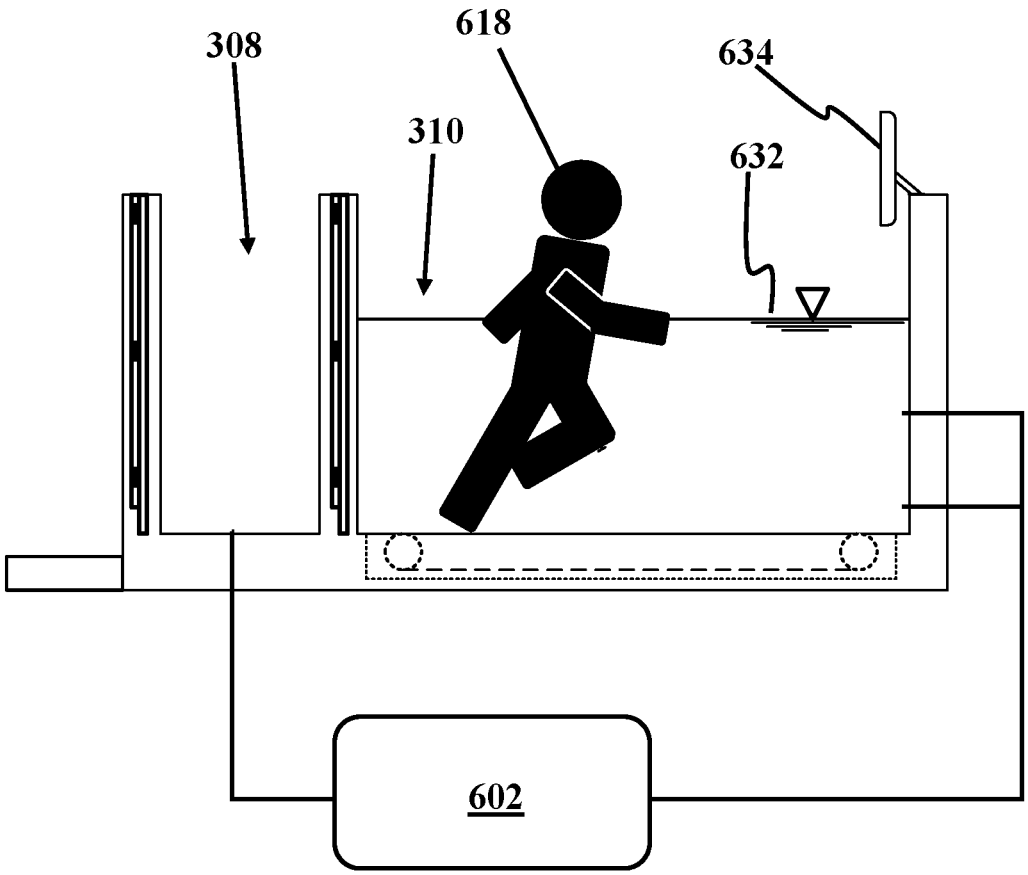
FIG. 6C illustrates a schematic left-view of an aquatic exercise apparatus connected in fluid communication with a water circulation system, consistent with one or more exemplary embodiments of the present disclosure.

FIGS. 6A-6C illustrate schematic left-views of aquatic exercise apparatus 300 connected in fluid communication with a water circulation system 602, consistent with one or more exemplary embodiments of the present disclosure. In an exemplary embodiment, water circulation system 602 may be similar to water circulation system 104 of FIG. 1.

Referring to FIG. 6A, water circulation system 602 may be connected in fluid communication with first tank portion 308 and second tank portion 310 and may be utilized to transfer the water between first tank portion 308 and second tank portion 310 in a manner that will be described later in this disclosure.

In an exemplary embodiment, water circulation system 602 may be connected to first tank portion 308 by a first pipe system 604 that may be connected in fluid communication with a bottom 608 of first tank portion 308 via a number of nozzles 610 arranged on bottom 608 of first tank portion 308. In an exemplary embodiment, water circulation system 602 may be further connected to second tank portion 310 by a second pipe system 612 that may be connected in fluid communication with an end wall 614 of second tank portion 310 at different heights via a number of nozzles 616 arranged on end wall 614. In exemplary embodiments, such an arrangement of nozzles 616 on end wall 614 may allow for circulating water within second tank portion 310 and pumping water against a walking or running direction of a user 618 and allowing user 618 to walk or run against the resistance of water being circulated in second tank portion 310 by water circulation system 602.

In an exemplary embodiment, aquatic exercise apparatus 300 and water circulation system 602 may further be functionally coupled with a control unit 603 similar to control unit 106 of FIG. 1. Referring to FIGS. 1 and 6A, in an exemplary embodiment, memory 1062 may include executable instructions that, when executed, cause processor 1064 to urge water circulation unit 602 to pump the water from second tank portion 310 to first tank portion 308 until the liquid in first tank portion 308 is leveled with the liquid in second tank portion 310, responsive to determining that user 618 is in first tank portion 308 and watertight entrance 304 is closed. In an exemplary embodiment, memory 1062 may further include executable instructions that, when executed, cause processor 1064 to urge water circulation unit 602 to pump the liquid from first tank portion 308 into second tank portion 310 until a desirable liquid level reached in second tank portion 310, responsive to determining that user 618 is in second tank portion 310 and watertight gate 306 is closed.

Figure 7:
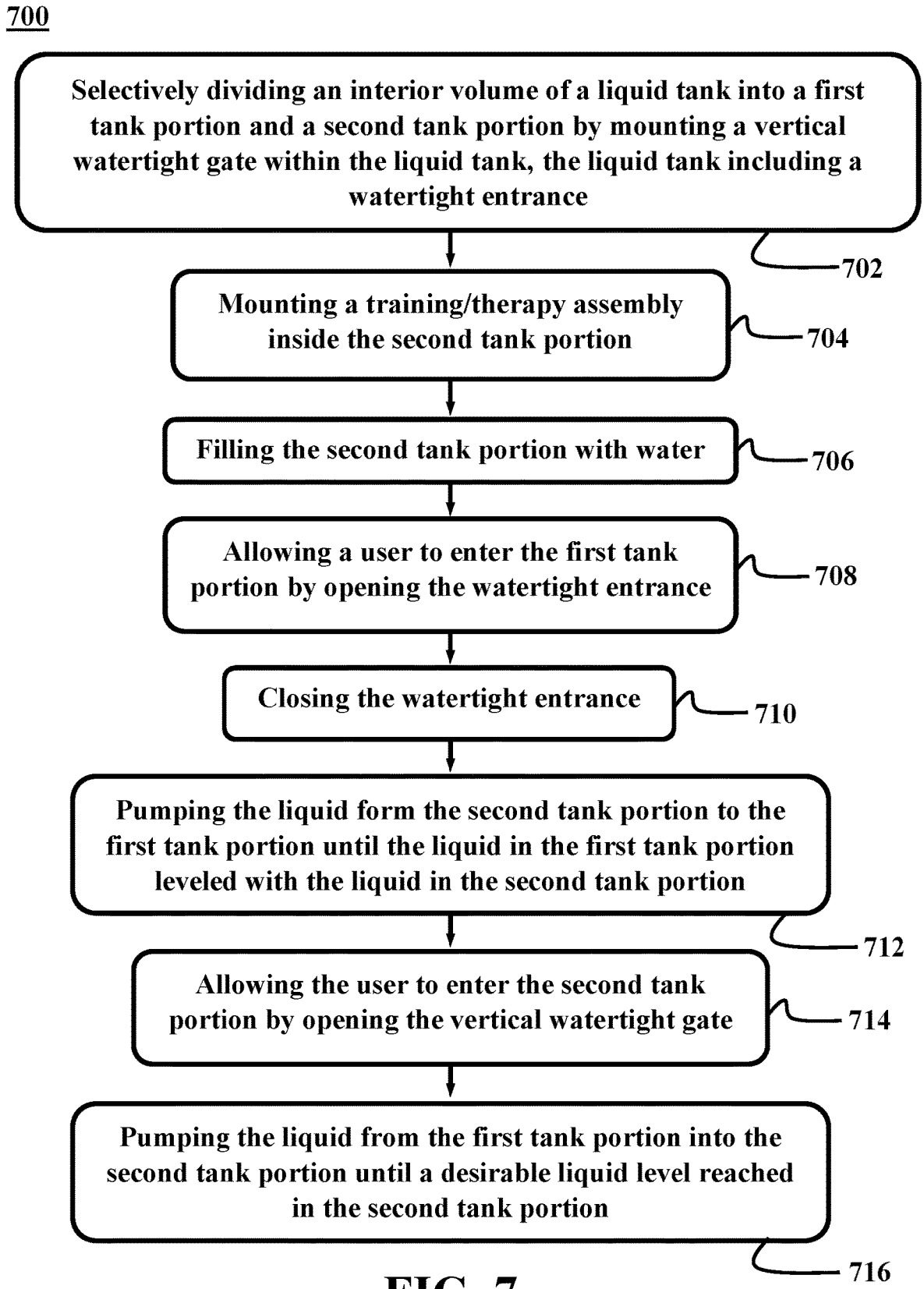
FIG. 7 illustrates a method for operating an aquatic exercise system, consistent with one or more exemplary embodiments of the present disclosure.

FIG. 7 illustrates a method 700 for operating an aquatic exercise system, consistent with one or more exemplary embodiments of the present disclosure. In an exemplary embodiment, method 700 may include a step 702 of dividing an interior volume of a water tank into a first tank portion and a second tank portion by mounting a vertical watertight gate within the water tank, where the water tank may include a watertight entrance, a step 704 of mounting a training/therapy assembly inside the second tank portion, a step 706 of filling the second tank portion with water, a step 708 of allowing a user to enter the first tank portion by opening the watertight entrance, a step 710 of closing the watertight entrance, a step 712 of pumping the water from the second tank portion to the first tank portion until the liquid in the first tank portion is leveled with the liquid in the second tank portion, a step 714 of allowing a user to enter the second tank portion by opening the watertight gate, and a step 716 of pumping the water from the first tank portion into the second tank portion until a desirable water level is reached in the second tank portion.

In an exemplary embodiment, step 702 of dividing an interior volume of the water tank into the first tank portion and the second tank portion by mounting the vertical watertight gate within the water tank may involve dividing the interior volume of the water tank into the first tank portion and the second tank portion such that the first tank portion and the second tank portion may be isolated from each other in a watertight manner by the vertical watertight gate. As used herein, in a watertight manner may refer to not allowing water to pass or leak from the first tank portion into the second tank portion or vice versa while the vertical watertight gate is closed. For example, with further reference to FIG. 3C, water tank 302 may be divided into first tank portion 308 and second tank portion 310 by mounting watertight gate 306 within water tank 302.

Referring to FIGS. 3A, 6A, and 7, in an exemplary embodiment, step 704 may involve mounting the training/therapy assembly inside the second tank portion. For example, treadmill assembly 312 may be mounted inside second tank portion 310 as the training/therapy assembly. In an exemplary embodiment, aquatic exercise apparatus 300 may include a unitary base 620 that may form the unitary base of water tank 302. In an exemplary embodiment, a recessed portion or cavity (labeled as 622 and designated by broken lines in FIG. 6A) may be formed within unitary base 620 in second tank portion 310 within which treadmill assembly 312 may be mounted.

Referring to FIG. 6A, in an exemplary embodiment, treadmill assembly 312 may include two rollers 3122*a-b*, one idler roller 3122*a* at one end of treadmill assembly 312 and an active or live roller 3122*b* at the other end of treadmill assembly 312. An endless treadmill belt 3124 may extend around idler roller 3122*a* and active roller 3122*b* and active roller 3122*b* may be driven by an external actuator 624, such as an electric motor. In an exemplary embodiment, top surface 626 of endless treadmill belt 3124 may lie flush with a bottom surface 628 of second tank portion 310 (visible in FIGS. 3A and 6A).

Figure 8A:
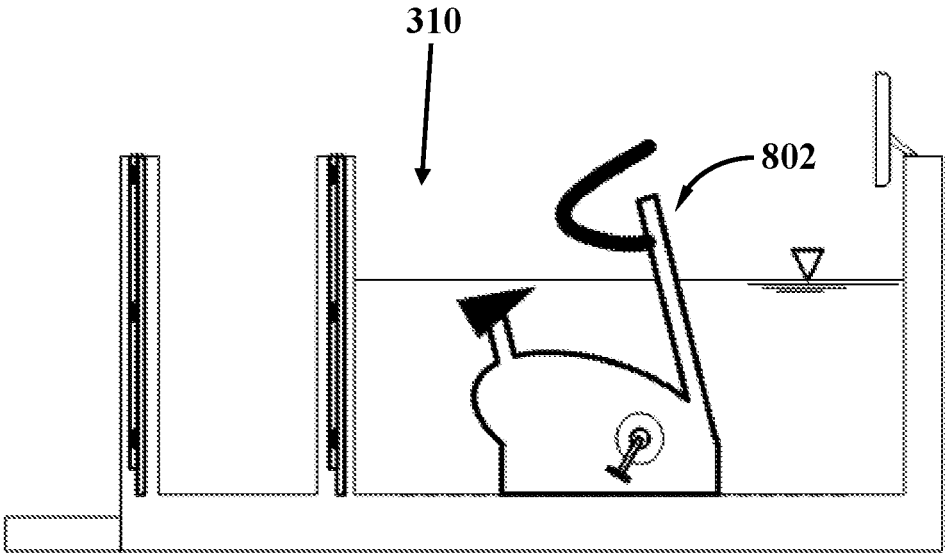
FIG. 8A illustrates a schematic left-view of an aquatic exercise apparatus with an exercise bike, consistent with one or more exemplary embodiments of the present disclosure.

FIG. 8A illustrates a schematic left-view of aquatic exercise apparatus 300 with an exercise bike 802, consistent with one or more exemplary embodiments of the present disclosure. In an exemplary embodiment, exercise bike 802 may be disposed within second tank portion 310 as a training/therapy assembly similar to training/therapy assembly 1210 of FIG. 1. In an exemplary embodiment, a user may utilize exercise bike 802 to perform cycling exercises while being partially submerged in water in second tank portion 310.

Figure 8B:
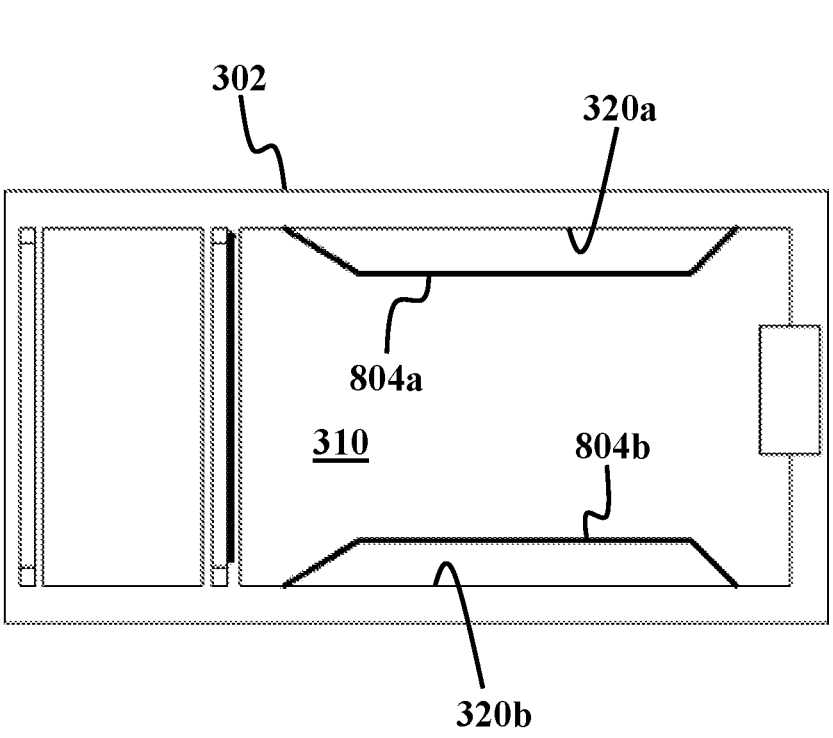
FIG. 8B illustrate a schematic top-view of an aquatic exercise apparatus with support railings, consistent with one or more exemplary embodiments of the present disclosure.

FIG. 8B illustrate a schematic top-view of aquatic exercise apparatus 300 with support railings 804*a-b*, consistent with one or more exemplary embodiments of the present disclosure. In an exemplary embodiment, support railings 804*a-b* may be attached at either one of side walls 320*a-b* adjacent top edges of side walls 320*a-b*. In an exemplary embodiment, each support railing 804*a* or 804*b* may be a support bar attached to a corresponding side wall 320*a* or 320*b* of water tank 302. A user may utilize support railings 804 to perform different physical training and therapy moves while being partially submerged in water in second tank portion 310.

Referring to FIGS. 8A-B and 7, in an exemplary embodiment, step 704 may involve mounting the training/therapy assembly inside the second tank portion. For example, training/therapy assembly may include exercise bike 802 that may be mounted inside second tank portion 310 of aquatic exercise apparatus 300. Alternatively, training/therapy assembly may include may include support railings 804*a-b* that may be attached at either one of side walls 320*a-b* of water tank 302.

Referring to FIGS. 6A and 7, in an exemplary embodiment, step 706 may involve filling the second tank portion with water. For example second tank portion 310 may be filled with a total amount of water that may be required during the operation of aquatic exercise apparatus 300. In exemplary embodiments, using second tank portion 310 to store the total amount of water required in aquatic exercise apparatus 300 may eliminate a need for a separate water tank that may hold the required water as is the case in most aquatic treadmill assemblies. An aquatic treadmill assembly may take up an amount of water as heavy as two metric tons, therefore, in order to have an aquatic treadmill assembly and a separate water tank storing the required water for the aquatic treadmill assembly may need laying two separate foundations for the treadmill assembly and the water tank, which is a costly and time-consuming process. Referring to FIG. 6A, in an exemplary embodiment, second tank portion 310 is filled with water while watertight gate 306 is tightly closed and first tank portion 308 is empty before the underwater exercise begins.

Referring to FIGS. 6A and 7, in an exemplary embodiment, step 708 of allowing the user to enter the first tank portion may involve opening the watertight entrance of the water tank. For example, watertight entrance 304 may be opened and user 618 may enter first tank portion 308. In an exemplary embodiment, in step 710 of method 700, when user 618 enters first tank portion 308, watertight entrance 304 may be closed behind user 618.

Referring to FIGS. 6B and 7, in an exemplary embodiment, step 712 may involve pumping the water from the second tank portion to the first tank portion once the user is in the first tank portion and the watertight entrance is tightly closed. For example, water circulation system 602 may pump the water from second tank portion 310 into first tank portion 308 until water level 630 in first tank portion 308 reaches water level 632 in second tank portion 310.

In an exemplary embodiment, step 714 of allowing the user to enter the second tank portion may involve opening the watertight gate. For example, watertight gate 306 may be opened to allow user 618 to enter second tank portion 310 while water level 630 in first tank portion 308 equals water level 632 in second tank portion 310.

Referring to FIGS. 6C and 7, in an exemplary embodiment, step 716 involves pumping the water from the first tank portion into the second tank portion until a desirable water level is reached in the second tank portion. For example, water circulation system 602 may be utilized to pump the water from first tank portion 308 to second tank portion 310 until water level 632 in second tank portion 310 reaches a desirable level. As used herein a desirable level of water may include a waist-high level or a chest-high level depending on the type of exercise or therapy that user 618 is receiving. Depending on the desired level of water in second tank portion 310, in exemplary embodiments either all the water in first tank portion 308 is transferred into second tank portion 310 or a partial amount of water may be transferred from first tank portion 308 into second tank portion 310.

Referring to FIG. 6C, in an exemplary embodiment, when water level 632 in second tank portion 310 reaches a desirable level, user 618 may begin their aquatic exercise or aquatic therapy session by turning on treadmill assembly 312 utilizing a user-interface unit 634 either by themselves or by an attendant or therapist. In an exemplary embodiment, user-interface unit 634 may be similar to user interface unit 108 of FIG. 1.

Referring to FIG. 6B, in an exemplary embodiment, in order to allow user 618 to exit aquatic exercise apparatus 300 once their exercise or therapy is over, the water in second tank portion 310 may be pumped into first tank portion 308 until the water level in first tank portion 308 is similar to the water level in second tank portion 310, then watertight gate 306 may be opened to allow user 618 to exit second tank portion 310 into first tank portion 308. After that, the entire water in first tank portion 308 may be pumped back into second tank portion 310. Then, watertight entrance 304 may be opened to allow user 618 out of aquatic exercise apparatus 300.

With reference to FIG. 7, in exemplary embodiments, method 700 of operating an aquatic exercise system, not only eliminates a need for a separate water storage tank by storing the entire water in the second tank portion of the aquatic exercise apparatus, but also may allow for a faster transfer of a user into and out of the aquatic exercise apparatus, which is beneficial especially when working with elderly, injured, or overweight users that are not able to tolerate slow process of pumping the entire water from an external storage tank into the exercise system and vice versa.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. An aquatic exercise system, comprising:

a water tank comprising a watertight entrance, the watertight entrance configured to allow a user enter and exit the water tank;

a vertical watertight gate disposed within the water tank, the vertical watertight gate configured to divide an interior of the water tank into a first tank portion and a second tank portion;

a training/therapy assembly disposed within the second tank portion;

a water circulation system, the water circulation system comprising a water pump connected in fluid communication with the first tank portion and the second tank portion via a plurality of pipes, the water circulation system configured to transfer the water between the first tank portion and the second tank portion; and a control unit functionally coupled with the water circulation system, the control unit comprising:

a processor; and a memory coupled with the processor, the memory including executable instructions that, when executed, cause the processor to:

urge the water circulation unit to pump the water from the second tank portion to the first tank portion until the liquid in the first tank portion leveled with the liquid in the second tank portion, responsive to determining that the user is in the first tank portion and the watertight entrance is closed; and urge the water circulation unit to pump the liquid from the first tank portion into the second tank portion, responsive to determining that the user is in the second tank portion and the watertight gate is closed.

2. The system according to claim 1, wherein the water tank comprises a unitary base, two side-panels, an end-wall, and an end opening configured to be closed by the watertight entrance.

3. The system according to claim 2, wherein the training/therapy assembly is one of a treadmill assembly, an exercise bike, and support railings, the support railings attached to either one of the two side panels.

4. The system according to claim 2, wherein the vertical watertight gate comprises:

a U-shaped frame comprising a first upright frame member, a second upright frame member, and a horizontal frame member, the first upright frame member and the second upright frame member attached to the two side-panels and the horizontal frame member secured to the unitary base; and a structural panel hinged to the first upright frame member by a plurality of hinges coupled to a first edge of the structural panel, the structural panel pivoting on the plurality of hinges about a pivot axis defined by the plurality of hinges.

5. The system according to claim 4, wherein the structural panel further comprises a continuous groove along upright and bottom margins of the structural panel, wherein a sealing strip is secured within the continuous grove projecting outward toward the U-shaped frame.

6. The system according to claim 5, wherein the vertical watertight gate further comprises a lock system, the lock system comprising:

an upright attachment member extended along and attached to the second upright frame member, the upright attachment member comprising an elongated member with a U-shaped profile with a first set of rectangular slots cut into the elongated member;

an elongated upright link pivotally coupled with the upright attachment member by a plurality of coupling joints spaced apart along a height of the elongated upright link, each coupling joint comprising a leg coupled at one end to the upright attachment member by a first pin joint and at an opposing end to the elongate upright link by a second pin joint, the elongated upright link parallel to the upright attachment member moveable toward the upright attachment member in a locked position and movable away from the upright attachment member in an unlocked position; and a plurality of lock plates secured to a second edge of the structural panel in alignment with the first set of rectangular slots, each of the plurality of lock plates shaped and sized to fit within a corresponding slot of the first set of rectangular slots.

7. The system according to claim 6, wherein the elongated upright link comprises a second set of rectangular slots cut into the elongated upright link, the second set of rectangular slots out of alignment with the first set of rectangular slots and the elongated upright link pressing the plurality of lock plates into the first set of rectangular slots in the locked position.

8. The system according to claim 6, wherein the elongated upright link comprises a second set of rectangular slots cut into the elongated upright link, the second set of rectangular slots aligned with the first set of rectangular slots in the unlocked position allowing the plurality of lock plates to freely move in and out of the first set of rectangular slots.

9. The system according to claim 2, wherein the watertight entrance comprising:

a U-shaped frame comprising a first upright frame member, a second upright frame member, and a horizontal frame member, the first upright frame member and the second upright frame member secured to the two side-panels adjacent the end opening and the horizontal frame member secured to the unitary base adjacent the end opening; and a structural panel hinged to the first upright frame member by a plurality of hinges coupled to a first edge of the structural panel, the structural panel pivoting on the plurality of hinges about a pivot axis defined by the plurality of hinges.

10. The system according to claim 9, wherein the watertight entrance further comprises a lock system, the lock system comprising:

an upright attachment member extended along and attached to the second upright frame member, the upright attachment member comprising an elongated member with a U-shaped profile with a first set of rectangular slots cut into the elongated member;

an elongated upright link pivotally coupled with the upright attachment member by a plurality of coupling joints spaced apart along a height of the elongated upright link, each coupling joint comprising a leg coupled at one end to the upright attachment member by a first pin joint and at an opposing end to the elongate upright link by a second pin joint, the elongated upright link parallel to the upright attachment member moveable toward the upright attachment member in a locked position and movable away from the upright attachment member in an unlocked position; and a plurality of lock plates secured to a second edge of the structural panel in alignment with the first set of rectangular slots, each of the plurality of lock plates shaped and sized to fit within a corresponding slot of the first set of rectangular slots.

11. The system according to claim 1, wherein the water circulation system further comprises:

a fluid filtration unit comprising at least one of a sand filter and a membrane filter, the fluid filtration unit configured to filter out suspended particles and organic compounds from the circulated water.

12. An aquatic exercise system, comprising:

a water tank comprising a watertight entrance, the watertight entrance configured to allow a user enter and exit the water tank;

a vertical watertight gate disposed within the water tank, the vertical watertight gate configured to divide an interior of the water tank into a first tank portion and a second tank portion;

a training/therapy assembly disposed within the second tank portion; and a water circulation system comprising a water pump connected in fluid communication with the first tank portion and the second tank portion via a plurality of pipes, the water circulation system configured to transfer the water between the first tank portion and the second tank portion, wherein the training/therapy assembly comprises a treadmill assembly, the treadmill assembly comprising two rollers and an endless treadmill belt extending around the two rollers, the treadmill assembly disposed within a recessed section in a base of the water tank, a top surface of the treadmill belt lying flush with a top surface of the base.

13. A method for operating an aquatic exercise system, the method comprising:

dividing an interior volume of a water tank into a first tank portion and a second tank portion by mounting a vertical watertight gate within the water tank, the first tank portion and the second tank portion being isolated from each other in a watertight manner by the vertical watertight gate, the water tank including a watertight entrance allowing a user in and out of the water tank;

mounting a training/therapy assembly inside the second tank portion;

filling the second tank portion with water;

allowing the user to enter the first tank portion by opening the watertight entrance;

closing the watertight entrance;

pumping the water from the second tank portion to the first tank portion until the liquid in the first tank portion leveled with the liquid in the second tank portion;

allowing the user to enter the second tank portion by opening the vertical watertight gate;

closing the vertical watertight gate; and pumping the liquid from the first tank portion into the second tank portion until a predetermined liquid level is reached in the second tank portion.

14. The method according to claim 13, wherein the water tank comprises two side panels, an end-panel, and a unitary base, wherein mounting the vertical watertight gate within the water tank comprises:

attaching a U-shaped frame within the water tank, the U-shaped frame comprising a first upright frame member, a second upright frame member, and a horizontal frame member, the first upright frame member and the second upright frame member attached to the two side-panels and the horizontal frame member secured to the unitary base; and hinging a structural panel to the first upright frame member by a plurality of hinges coupled to a first edge of the structural panel, the structural panel pivoting on the plurality of hinges about a pivot axis defined by the plurality of hinges.

15. The method according to claim 14, wherein closing the vertical watertight gate comprises latching the structural panel against the U-shaped frame in a watertight manner by a lock system, the lock system comprising:

an upright attachment member extended along and attached to the second upright frame member, the upright attachment member comprising an elongated member with a U-shaped profile with a first set of rectangular slots cut into the elongated member;

an elongated upright link pivotally coupled with the upright attachment member by a plurality of coupling joints spaced apart along a height of the elongated upright link, each coupling joint comprising a leg coupled at one end to the upright attachment member by a first pin joint and at an opposing end to the elongate upright link by a second pin joint, the elongated upright link parallel to the upright attachment member moveable toward the upright attachment member in a locked position and movable away from the upright attachment member in an unlocked position; and a plurality of lock plates attached to a second edge of the structural panel in alignment with the first set of rectangular slots, each of the plurality of lock plates shaped and sized to fit within a corresponding slot of the first set of rectangular slots.

16. The method according to claim 15, wherein the structural panel further comprises a continuous groove along upright and bottom margins of the structural panel, wherein a sealing strip is secured within the continuous grove projecting outward toward the U-shaped frame, and wherein latching the structural panel against the U-shaped frame in a watertight manner by the lock system comprises pressing the structural panel against the U-shaped frame by the lock system such that the sealing strip is tightly pressed between the structural panel and the U-shaped frame.

17. The method according to claim 13, wherein mounting the training/therapy assembly inside the second tank portion comprises mounting a treadmill assembly inside the second tank portion, the treadmill assembly comprising two rollers and an endless treadmill belt extending around the two rollers, the treadmill assembly disposed within a recessed section in a base of the water tank, a top surface of the treadmill belt lying flush with a top surface of the base.

18. The method according to claim 13, wherein allowing the user to enter the first tank portion comprises opening the watertight entrance, the watertight entrance comprising:

a U-shaped frame comprising a first upright frame member, a second upright frame member, and a horizontal frame member, the first upright frame member and the second upright frame member secured to two side-panels adjacent an end opening and the horizontal frame member secured to a unitary base adjacent the end opening;

a structural panel hinged to the first upright frame member by a plurality of hinges coupled to a first edge of the structural panel, the structural panel pivoting on the plurality of hinges about a pivot axis defined by the plurality of hinge; and a lock system comprising a plurality of lock plates secured to a second edge of the structural panel in alignment with a first set of rectangular slots, each of the plurality of lock plates shaped and sized to fit within a corresponding slot of the first set of rectangular slots.

* * * * *